US006766538B2

(12) United States Patent
Park

(10) Patent No.: US 6,766,538 B2
(45) Date of Patent: Jul. 27, 2004

(54) IMAGE-PRINTED VISORS AND METHODS OF MANUFACTURING

(76) Inventor: Sung-Yang Park, 791 Paulison Ave., Clifton, NJ (US) 07011

( * ) Notice: Subject to any disclaimer, the term of this patent is extended or adjusted under 35 U.S.C. 154(b) by 0 days.

(21) Appl. No.: 10/126,158

(22) Filed: Apr. 20, 2002

(65) Prior Publication Data

US 2003/0196248 A1 Oct. 23, 2003

(51) Int. Cl.[7] ..... A42B 1/00

(52) U.S. Cl. ..... 2/175.4; 2/10; 2/209.13; 40/329

(58) Field of Search ..... 2/195.1, 195.6, 2/175.1, 175.2, 175.3, 175.4, 175.5

(56) References Cited

U.S. PATENT DOCUMENTS 5,487,191 A * 1/1996 Ridley ..... 2/195.1
5,592,696 A * 1/1997 Oliver ..... 2/175.3
D385,091 S * 10/1997 Rodgers ..... D2/893
5,701,607 A * 12/1997 Kaiser ..... 2/209.13
5,815,831 A * 10/1998 De Wan ..... 2/10
D403,140 S * 12/1998 Goranovic ..... D2/872
5,903,923 A * 5/1999 Morse et al. ..... 2/195.1
5,956,773 A * 9/1999 LaMantia ..... 2/195.1
6,418,562 B1 * 7/2002 Shwartz et al. ..... 2/209.13
6,449,773 B1 * 9/2002 Shwartz et al. ..... 2/195.1

* cited by examiner

*Primary Examiner*—Katherine Moran

(57) ABSTRACT

A brim or visor for hats is described which includes a brim cover and a brim insert securely affixed within the brim cover. The brim cover comprises an upper sheet having an image printed to one side thereof; and a lower sheet attached to the upper sheet to form a pocket adapted to receive the brim insert. The brim insert is securely affixed within the pocket such that the image printed on the upper sheet lays substantially flat over the brim insert.

18 Claims, 6 Drawing Sheets

IMAGE-PRINTED VISORS AND METHODS OF MANUFACTURING

BACKGROUND

1. Field

The present invention generally relates to a headwear, and in particular, to brims or visors for hats and methods of manufacturing.

2. Background

Sports caps are generally constructed of a fabric crown portion shaped to fit over the head and semi-rigid brim or visor attached to the crown portion. The brim typically extends forward a front section of the peripheral edge of the crown portion and may serve to shield the face of the wearer from the sun and rain. The brim is typically constructed of a brim insert and fabric material sewn to the top and bottom of the brim insert. Typically, a number of rows (e.g., eight rows) of stitches are used to firmly attach the fabric material to the brim insert.

The brims of caps, such as baseball style caps, may be shaped by the wearer to conform to his/her style. To enable shaping of the brim, the brim typically includes an insert (e.g., cardboard, plastic insert, etc) made of a semi-rigid material.

SUMMARY

According to one aspect of one embodiment of the present invention, an image printed brim or visor for hats is provided. The brim comprises a brim cover and a brim insert securely affixed within the brim cover. The brim cover comprises an upper sheet having an image printed to one side thereof; and a lower sheet attached to the upper sheet to form a pocket adapted to receive the brim insert. The brim insert is securely affixed within the pocket such that the image printed on the upper sheet lays substantially flat over the brim insert.

In another aspect of one embodiment, the upper sheet is formed of thin flexible plastic sheet material having an image printed thereon. The upper sheet may be formed of a single-piece transparent material to allow the image printed on one side thereof to be visible from the other side.

In a further aspect of the one embodiment, the brim cover is sized and shaped such that when the brim insert is placed inside, the image printed on the upper sheet will lay substantially flat over the top surface of the brim insert. The image-printed upper sheet may be cut to a shape to cover substantially the entire top surface of the brim and extend over at least a portion of the side edge of the brim insert. In a preferred embodiment, the image-printed upper sheet is sized to cover not only the top surface of the brim but also to extend along substantially the entire side edge of the brim.

In yet another aspect of one embodiment, a brim is manufactured by first printing an image on one side of a thin flexible plastic sheet. The image-printed plastic sheet is cut to a desired brim shape. Additionally, a fabric sheet is cut to a desired brim shape. Once both the plastic sheet and the fabric sheet have been cut, they are aligned on top of each other. Then, the plastic sheet and the fabric sheet are attached together by sewing along peripheral edges thereof to form a brim cover. The brim cover is flipped over (i.e., inner surface turned out) such that the image printed on the plastic sheet is visible from the outside. Then a brim insert is placed inside the pocket formed in the brim cover and secured within the brim cover by sewing adjacent one edge of the brim insert.

According to one aspect of an alternative embodiment of the present invention, a brim comprises a transparent brim-shaped member and a printed image provided on one side of the transparent brim-shaped member such that the printed image is visible through the transparent brim-shaped member. In one embodiment, an image is printed on a separate base material and the image printed base material may be disposed on one side of the transparent brim-shaped member. In one embodiment, the transparent brim-shaped member is made of a flexible material. And the brim further comprises a brim-support member made of a semi-rigid material for attachment to the lower side of the transparent brim-shaped member to maintain the shape of the brim.

BRIEF DESCRIPTION OF THE DRAWINGS

The features, aspects, and advantages of the present invention will become more-fully apparent from the following Detailed Description, appended claims, and accompanying drawings in which:

DETAILED DESCRIPTION

Implementations of the present invention are described herein for purposes of illustration, namely an image-printed brim or visor for hats. The brim comprises a brim cover and a brim insert securely affixed within the brim cover. The brim cover comprises an upper sheet having an image printed to one side thereof, and a lower sheet attached to the upper sheet to form a pocket adapted to receive the brim insert. The brim insert is securely affixed within the pocket such that the image printed on the upper sheet lays substantially flat over the brim insert.

In the context of the present invention, the term "brim" is used to describe a portion of a hat (e.g., baseball cap, open-headed visor cap, etc.) which extends from, for example, the front of the crown portion. Typically, brim (also referred as "visor") is attached to hats such as baseball caps and open-headed visor caps. Typically, brim extends forward a front section of the peripheral edge of the crown portion and may serve to shield the face of the wearer from the sun and rain. However, present invention may be implemented in brims attached to different types of hats and extending from different sections of the crown portion.

In the following description, specific details are set forth in order to provide a thorough understanding of the present invention. However, it will be apparent to one skilled in the art that the present invention may be practiced without these specific details. In other instances, well-known structures and techniques have not been shown in detail in order to avoid obscuring the present invention.

Figure 1:
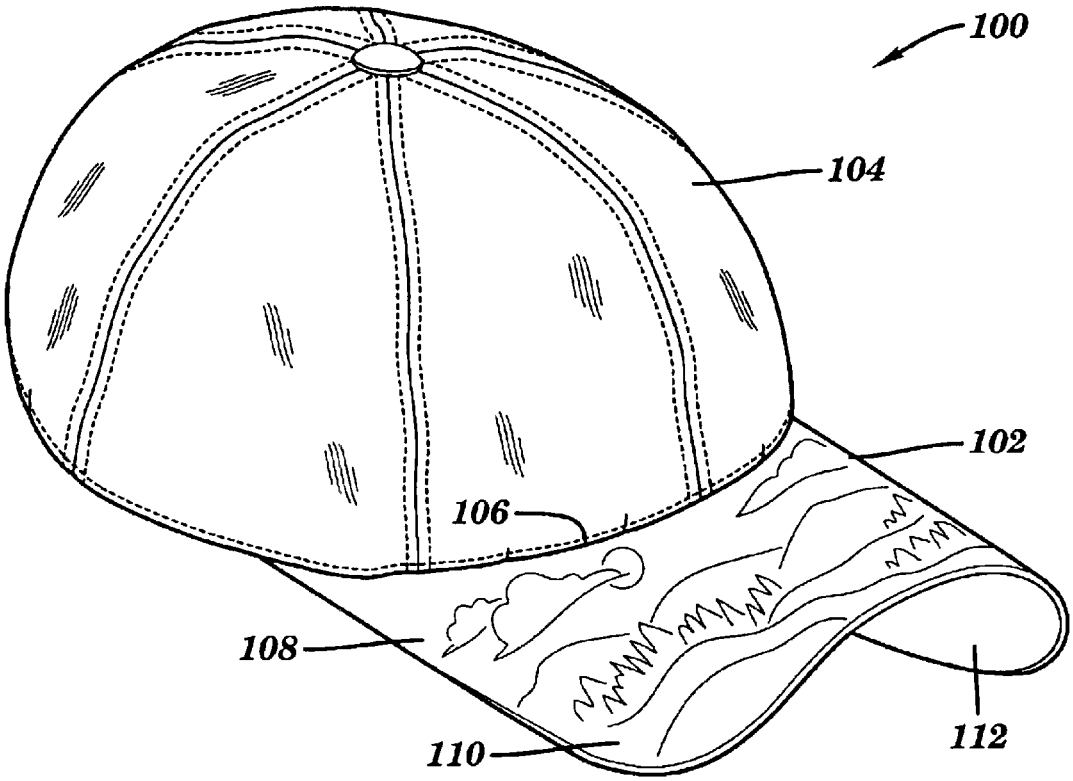
FIG. 1 is a perspective view of a baseball cap according to one embodiment of the present invention.

FIG. 1 shows an example of a baseball cap 100 including a brim 102 constructed according to one embodiment of the present invention. The baseball cap 100 includes a crown potion 104 and a brim 102 attached along a front section of the peripheral edge 106 of the crown portion 104. In the illustrated embodiment, the brim 102 has a substantially parabolic shape; however, other shapes may also be used. In one embodiment, the brim 102 comprises a brim cover 108 and a brim insert constructed of a semi-rigid material securely affixed within the brim cover 108 to provide shape and support for the brim. The brim cover 108 is constructed of an upper sheet 110 attached to the lower sheet 112 to form a pocket therebetween adapted to receive the brim insert.

Figure 2A:
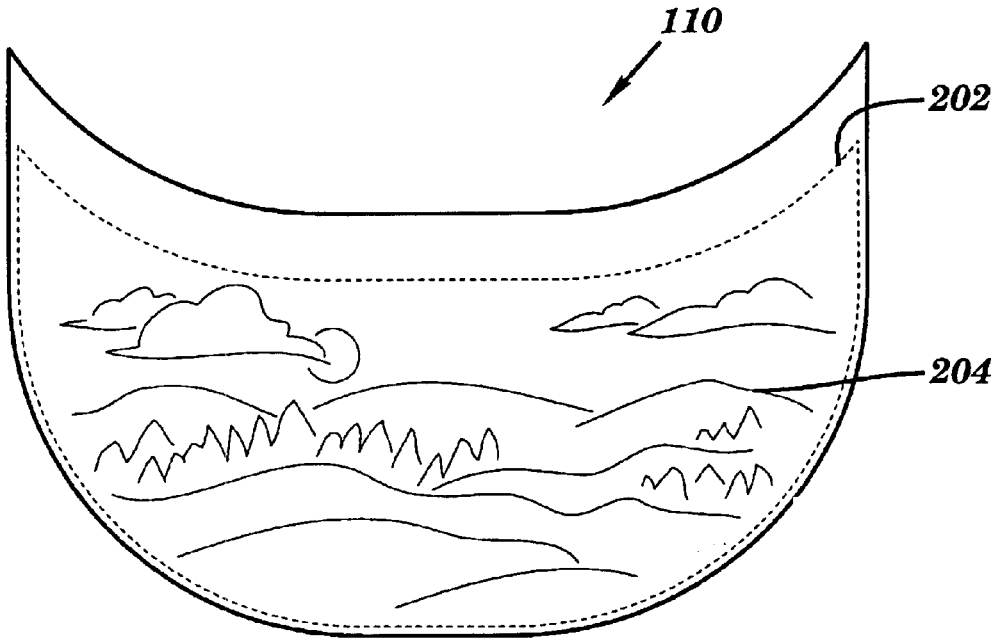
FIG. 2A is a top plan view of an upper sheet of a brim according to one embodiment of the present invention.

FIG. 2A shows an upper sheet 110 according to one embodiment of the present invention. In one embodiment, the upper sheet 110 is formed of a thin flexible sheet of a plastic material having an image printed thereon. Because thin flexible material is used, the upper sheet 110 will bend and flex naturally when the user of the baseball cap 100 shapes the brim 102 to conform to his/her style.

In one embodiment, the upper sheet 100 is formed of a semi-transparent or substantially transparent plastic material to allow the image printed on bottom side thereof to be visible from the top. In many instances, baseball caps 100 are worn outdoors and the brim 102 attached thereto serves to shield the face of the wearer from the sun and rain. Because a transparent plastic sheet is used to the construct the upper sheet 110, the image 204 printed on the bottom side is visible from the top. Additionally, the image 204 printed on the bottom side of the upper sheet 110 will not smear, bleed, run or fade after repeated wear because the printed image 204 is protected by the transparent plastic sheet and is not directly exposed to moisture or human touch.

In one embodiment, the upper sheet 110 is fabricated of a thin, flexible plastic sheet suitable for printing high-resolution image (e.g., high-resolution photographic or computer-generated images). In one embodiment, the upper sheet 110 is formed of polyvinyl chloride (PVC) material. The image 204 may be printed on the bottom side of the transparent material, i.e., the surface which faces the brim insert, using conventional printing technique. In one embodiment, after the image 204 has been printed on the transparent material, a white color layer is provided over the printed image to enhance the color of the printed image. Once high-resolution image 204 has been printed on the bottom side of the upper sheet 110, the upper sheet is cut to a desired brim shape. As seen by referring to FIG. 2A, that the upper sheet 100 is cut slight larger than the brim insert 202, the outline of which is shown in dotted-line. More specifically, the image-printed upper sheet is cut to a shape to cover substantially the entire top surface of the brim and extend over at least a portion of the side edge of the brim insert.

Although the described upper sheet is constructed of a plastic material, it should be noted that other materials (e.g., fabric substrate) suitable for printing a high-resolution image (e.g., photographic-generated images, computer-generated images) may also be used to construct the upper sheet.

Figure 2B:
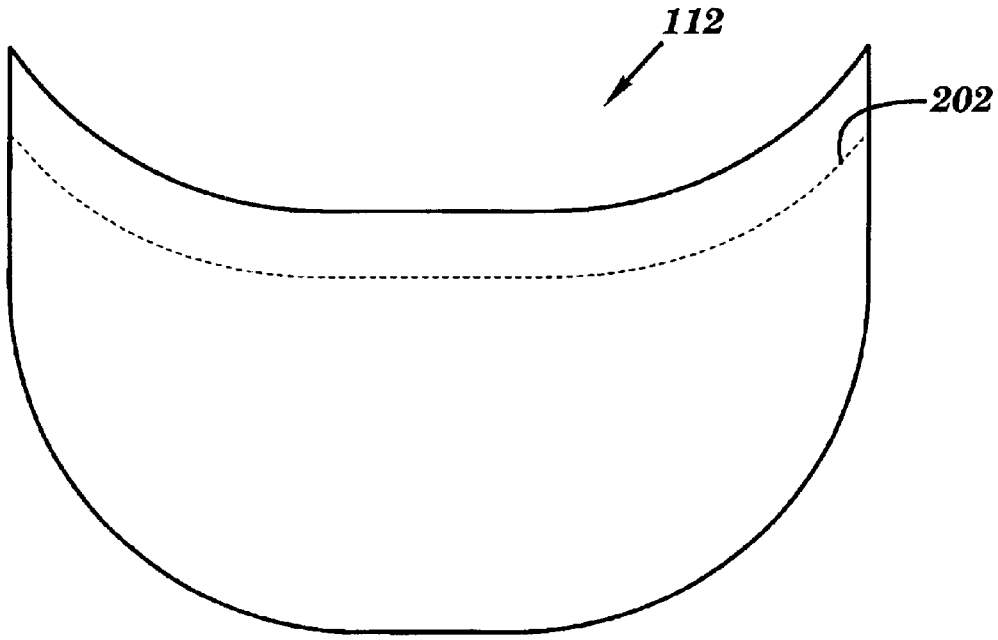
FIG. 2B is a top plan view of a lower sheet of a brim according to one embodiment of the present invention.

As shown in FIG. 2B, the lower sheet 112 formed of a fabric material and is cut to a desired brim shape.

Figure 3:
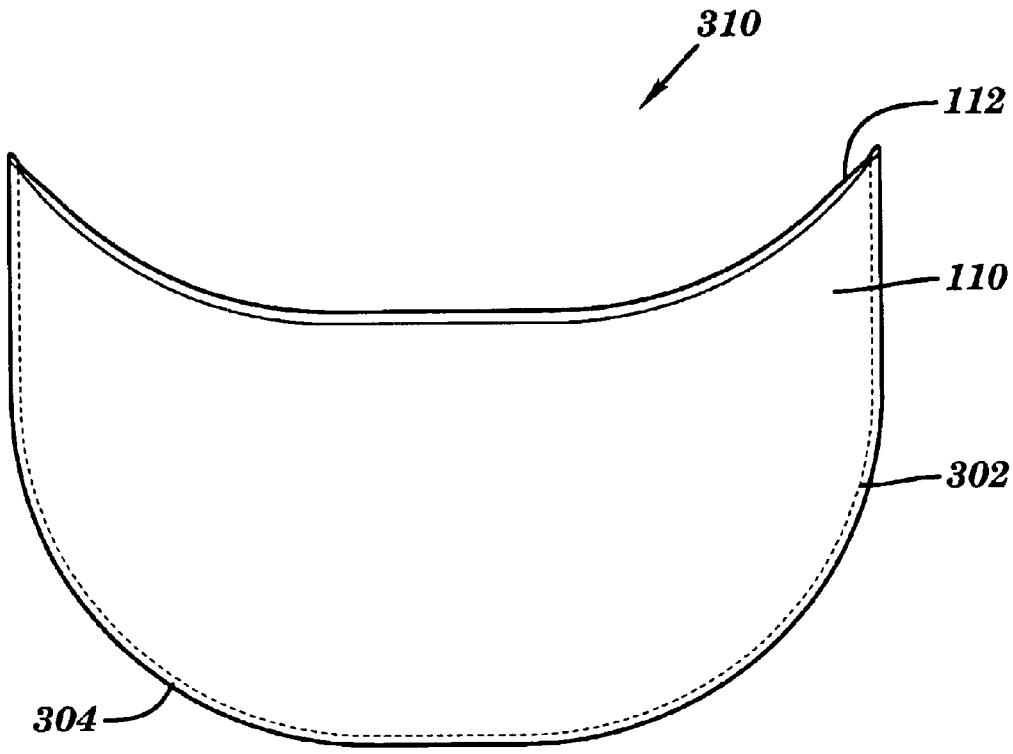
FIG. 3 is a top plan view of the upper sheet and the lower sheet stitched together along their outer edges to form a joined brim cover according to one embodiment of the present invention.
Figure 4:
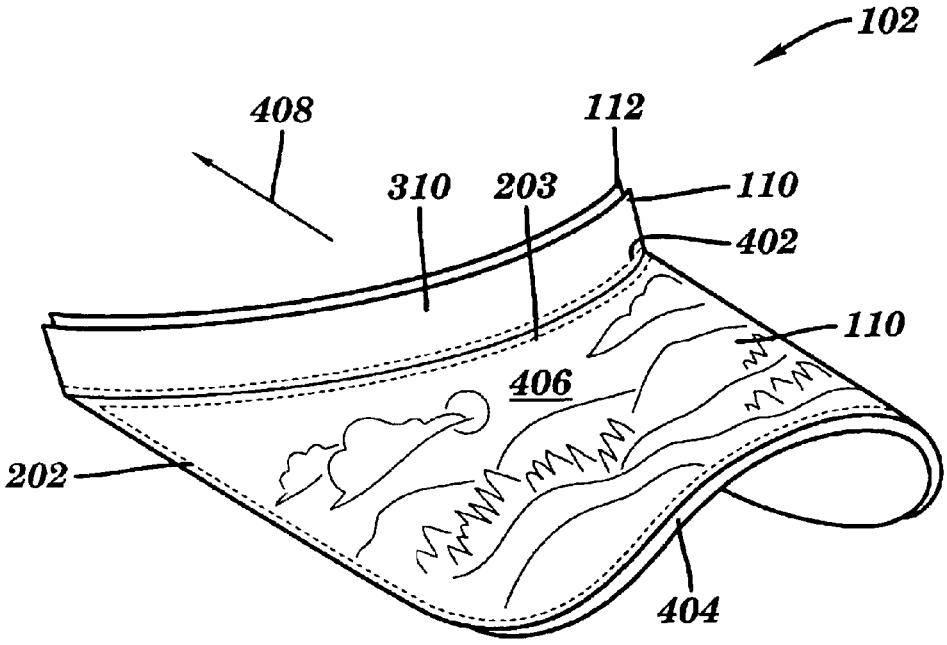
FIG. 4 is a perspective view of a brim for hats according to one embodiment of the present invention.

FIG. 3 shows the upper sheet 110 placed lying flat against the lower sheet 112 such that the image-printed side of the upper sheet is facing the lower sheet. Once the upper sheet and the lower sheet have been properly aligned, they are joined together along their outer edges by one row of stitches 302 to form a brim cover 310. Once the upper sheet 110 and the lower sheet 112 have been properly joined, the brim cover 310 is flipped over (i.e., inner surface turned out) such that the image-printed side of the upper sheet is visible from the outside. Once the brim cover has been flipped over, a pocket is formed therein with stitched portion 304 residing inside the pocket. A brim insert 202 made of a semi-rigid material is inserted in the pocket formed in the brim cover 310. After the brim insert 202 has been placed in the pocket formed in the brim cover 310, the brim cover is stitched by one row of stitches 402 adjacent to the upper edge of the brim insert 202 to prevent the brim insert from moving inside the brim cover, as shown in FIG. 4.

The brim cover 310 is configured such that when the brim insert 202 is placed inside the brim cover, the image-printed upper sheet 110 will lay substantially flat over the top surface of the brim insert. In one embodiment, the upper sheet 110 with image printed thereon extends over at least a portion of the side edge 404 of the brim insert. By doing so, the printed image is provided not only on the top surface 406 of the brim 102 but also continues along the side edges 404 of the brim. This may be accomplished by pulling the lower fabric sheet 112 in the direction 408 after the brim insert 202 has been securely placed in the brim cover 310 such that the upper sheet 110 is extended over the side edges 404 of the brim insert. When the image-printed upper sheet 110 has been properly extended over the side edges 404 of the brim insert 202, the brim cover 310 is stitched by one row of stitches 402 along the upper edge 203 of the brim insert such that the upper sheet and the lower sheet tightly covers to the brim insert. By doing so, the image-printed upper sheet 110 will lay flat over the brim insert and continue along the side edges of the brim. Additionally, because the upper sheet is made of flexible material, the upper sheet laying on top of the brim insert will flex and bend with the brim insert when the user of the hat shapes the brim. In other words, the image-printed upper sheet will lay smoothly over the brim insert regardless of whether the brim is shaped in curved configuration or in its original flat configuration.

It should be noted that in one embodiment, the upper sheet 110 lays smoothly over the brim insert without using a number of rows of stitches to firmly attached the upper sheet to the brim insert. This way the image printed on the upper sheet remains undisturbed. In contrast, a number of rows of stitches (e.g., eight rows of stitches) are used in conventional hats to firmly attach the upper and lower fabric material to the brim insert.

Figure 5:
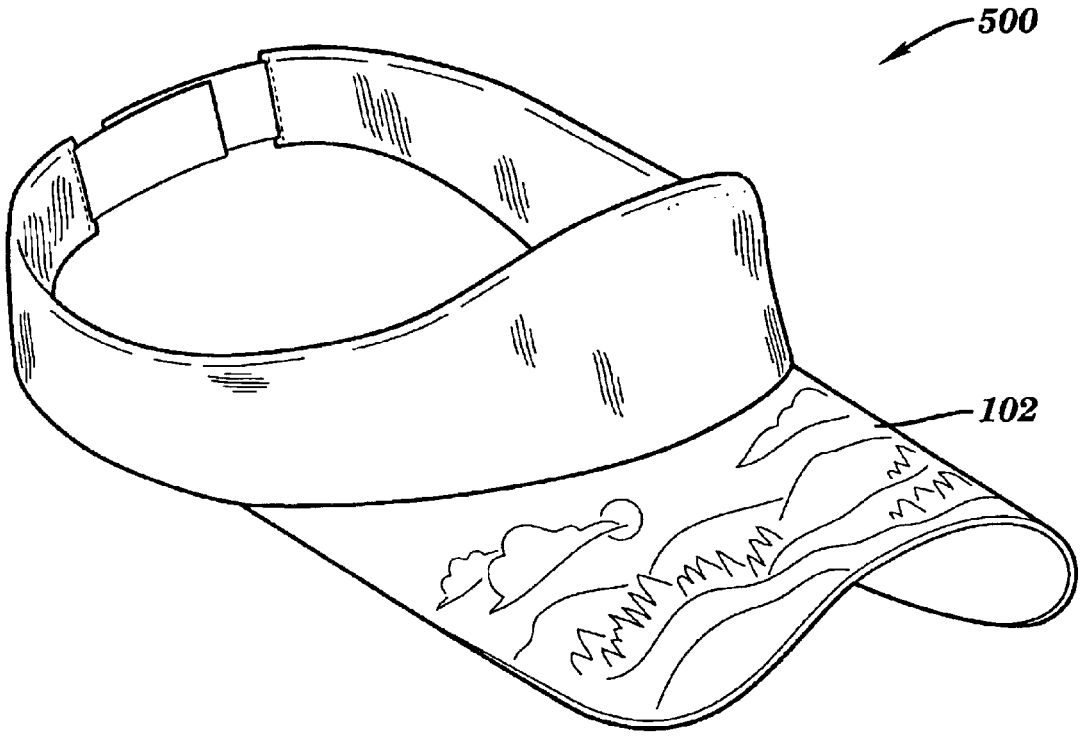
FIG. 5 is an open-headed brim cap according to one embodiment of the present invention.

In the illustrated embodiment shown in FIG. 1, the brim 102 constructed according to the present invention is attached to a baseball style cap 100. Alternatively, the brim 102 constructed according to the present invention may be adapted for attachment to other types of hats, including open-headed visor caps 500, as shown in FIG. 5.

Figure 6A:
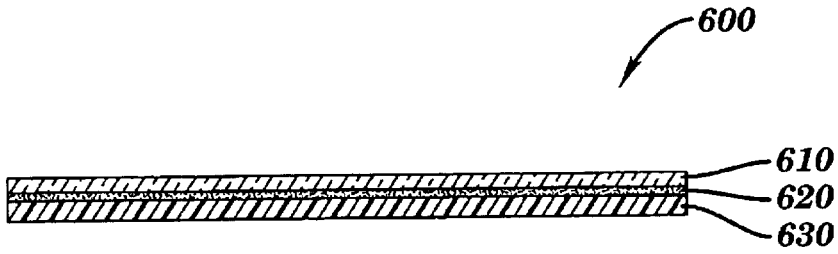
FIG. 6A is a cross-sectional elevational view of a brim for hats according to an alternative embodiment of the present invention.
Figure 6B:
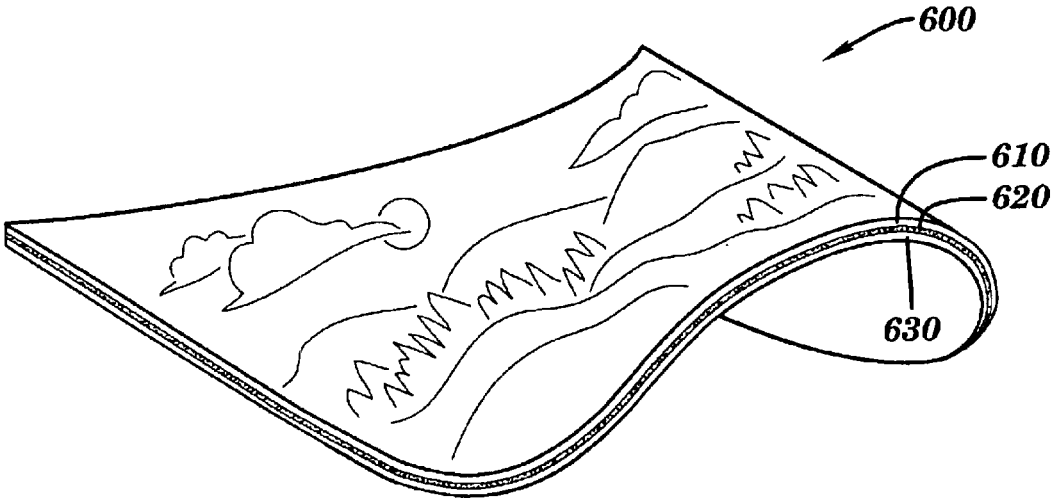
FIG. 6B is a perspective view of a brim for hats according to an alternative embodiment of the present invention.

FIGS. 6A and 6B show a brim 600 for hats according to alternative embodiment of the present invention. In this alternative embodiment, the brim 600 comprises a single-piece brim-shaped member 610 made of substantially transparent or semi-transparent material shaped to cover substantially the entire upper surface of the brim. The brim-shaped member may be formed of a flexible transparent material, such as rubber, transparent polymer, or translucent plastic material.

In first implementation of the alternative embodiment, an image is printed on a separate sheet 620 and the image-printed sheet is attached to one side of the transparent brim-shaped member 610 such that the image printed on the base material is visible through the transparent brim-shaped member 610. In one embodiment, the transparent brim-shaped member 610 is made of a flexible material. To provide support and maintain the shape of the flexible brim-shaped member 610, the brim 600 further comprises a brim-support member 630 made of a material having a greater stiffness (i.e., more rigid) than the transparent member. The brim-support member 630 is attached to the lower side of the transparent brim-shaped member 610 such that the image-printed sheet 620 is sandwiched between the support member 630 and the brim-shaped member 610. The transparent member 610 makes possible an unhindered viewing of the printed image disposed inside the brim 600. By placing the printed image between the transparent brim-shaped member and the support member, the printed image 620 is protected between the transparent brim-shaped member and the brim support member from being directly exposed to moisture or human touching.

In a second implementation of the alternative embodiment, an image 620 is printed directly on a transparent brim-shaped member 610. In this implementation, the image 620 is printed on the bottom surface of the transparent brim-shaped member 610. The brim-shaped member 610 is preferably made of transparent or semi-transparent material so that the image printed on the bottom surface thereof is visible from the top. Protective layer may be applied on the top of the printed image to protect the image. In one embodiment, the transparent brim-shaped member 610 may be made of a semi-rigid material so that the transparent brim-shaped member can serve as a hat brim and enable the user of the hat to shape the brim according to his/her style.

While the foregoing embodiments of the invention have been described and shown, it is understood that variations and modifications, such as those suggested and others within the spirit and scope of the invention, may occur to those skilled in the art to which the invention pertains. The scope of the present invention accordingly is to be defined as set forth in the appended claims.

What is claimed is:

1. A brim comprising a brim insert; and an upper sheet having an image printed directly thereon, the upper sheet attached to a lower sheet to form a brim cover, wherein the brim cover is securely affixed to said brim insert such that the image printed on the upper sheet lays substantially flat over the top surface of the brim inserts, wherein said brim insert made of a semi-rigid material to maintain the shape of the brim, and said lower sheet is made of flexible fabric material.

2. The brim of claim 1, wherein said upper sheet is made of a plastic substrate suitable for printing a high-resolution image directly thereon.

3. The brim of claim 1, wherein said upper sheet is made of transparent material and the image is printed on a bottom side thereof such that the image is visible from above.

4. The brim of claim 1, wherein said image-printed upper sheet is shaped to cover substantially the top surface of the brim insert and extend over at least a portion of the side edge of said brim insert.

5. The brim of claim 1, wherein said brim is configured for attachment to a baseball style cap.

6. The brim of claim 1, wherein said brim is configured for attachment to an open-headed style visor cap.

7. A method comprising:

printing an image directly on one side of a plastic sheet;

cutting the plastic sheet to a desired brim shape;

cutting a fabric material to a desired brim shape;

aligning the plastic sheet on top of the fabric material;

attaching the plastic sheet to the fabric material by sewing along peripheral edges thereof to form a joined brim cover;

flipping over the joined brim cover such that the image printed on the plastic sheet is visible from outside;

inserting a brim insert inside a pocket formed in the joined brim cover; and securing the brim insert within the pocket of the joined brim by sewing adjacent one edge of the brim insert to form a brim.

8. The method of claim 7, wherein said plastic sheet is formed of a material suitable for printing a high-resolution image directly thereon.

9. The method of claim 7, wherein said plastic sheet is made of transparent material to allow the printed image on one side thereof to be visible from the other side.

10. The method of claim 7, wherein said image-printed plastic sheet is cut to a shape to cover substantially the top surface of the brim insert and extend over at least a portion of the side edge of said brim insert.

11. The method of claim 7, further comprising attaching said brim to along a front section of the crown portion of a baseball style cap.

12. A cap comprising a crown portion adapted to fit over the head of a wearer; and a brim extending from the front of the crown portion, said brim comprising a brim insert; and a brim cover including an upper sheet having an image printed to one side thereof; and a lower sheet attached to the upper sheet to form a pocket adapted to receive the brim insert, wherein said brim insert is securely affixed within the pocket such that the image printed on the upper sheet lays substantially flat over the brim insert, wherein said upper sheet with image printed thereon extends over at least a portion of the side edge of said brim insert.

13. The cap of claim 12, wherein said upper sheet is made of a thin flexible plastic sheet material suitable for printing a high-resolution image directly thereon.

14. The cap of claim 12, wherein said upper sheet is made of transparent material and the image is printed on a bottom side thereof such that the image is visible from above.

15. The cap of claim 12, wherein said brim is configured for attachment to a baseball style cap.

16. The cap of claim 12, wherein said brim is configured for attachment to an open-headed style visor cap.

17. A cap comprising a crown portion adapted to fit over the head of a wearer; and a brim extending from the front of the crown portion, said brim comprising a brim insert; and a brim cover including an upper sheet having an image printed directly to one side thereof; and a lower sheet attached to the upper sheet to form a pocket adapted to receive the brim insert, wherein said brim insert is securely affixed within the pocket such that the image printed on the upper sheet lays substantially flat over the brim insert, wherein said upper sheet is made of transparent material and the image is printed on a bottom side thereof such that the image is visible from above.

18. A brim comprising a brim insert; and an upper sheet having an image printed directly thereon, the upper sheet attached to a lower sheet to form a brim cover, wherein the brim cover is securely affixed to said brim insert such that the image printed on the upper sheet lays substantially flat over the top surface of the brim insert, wherein said upper sheet is made of transparent material and the image is printed on a bottom side thereof such that the image is visible from above.

* * * * *